United States Patent [19]

Johnson et al.

[11] Patent Number: 4,728,039

[45] Date of Patent: Mar. 1, 1988

[54] PAINT SPRAY GUN NOZZLE ASSEMBLY

[75] Inventors: Myron J. Johnson, Arlington Heights; Robert L. Maggio, Elmhurst, both of Ill.

[73] Assignee: Stewart Warner Corporation, Chicago, Ill.

[21] Appl. No.: 939,357

[22] Filed: Dec. 8, 1986

[51] Int. Cl.[4] ..... B05B 1/28

[52] U.S. Cl. ..... 239/296; 239/300; 239/600

[58] Field of Search ..... 239/290, 296, 299, 300, 239/600, DIG. 19; 285/921

[56] References Cited

U.S. PATENT DOCUMENTS

| | | | |
|---|---|---|---|
| 2,504,116 | 4/1950 | Downs | 239/300 |
| 3,059,860 | 10/1962 | Hohn | 239/600 |
| 3,746,253 | 7/1973 | Walberg | 239/291 |
| 4,232,824 | 11/1980 | Binoche | 239/296 |
| 4,451,069 | 5/1984 | Melone | 285/921 |
| 4,502,629 | 3/1985 | McGhee et al. | 239/296 |

FOREIGN PATENT DOCUMENTS

| | | | |
|---|---|---|---|
| 704505 | 5/1931 | France | 239/290 |

*Primary Examiner*—Andres Kashnikow
*Assistant Examiner*—Karen B. Merritt
*Attorney, Agent, or Firm*—Lorusso & Loud

[57] ABSTRACT

A paint spray gun having a plastic nozzle body with a separate plastic nozzle tip universally mounted on the nozzle body to align the tip in a central orifice in a plastic air cap.

11 Claims, 7 Drawing Figures

FIG. 1
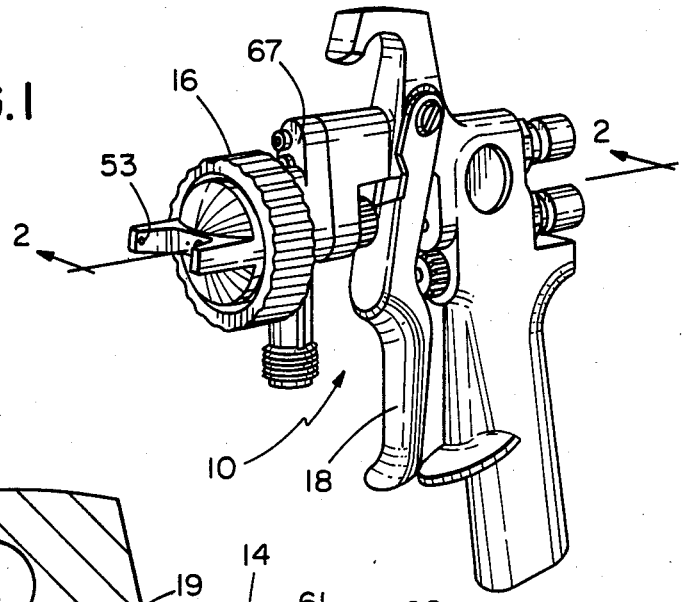
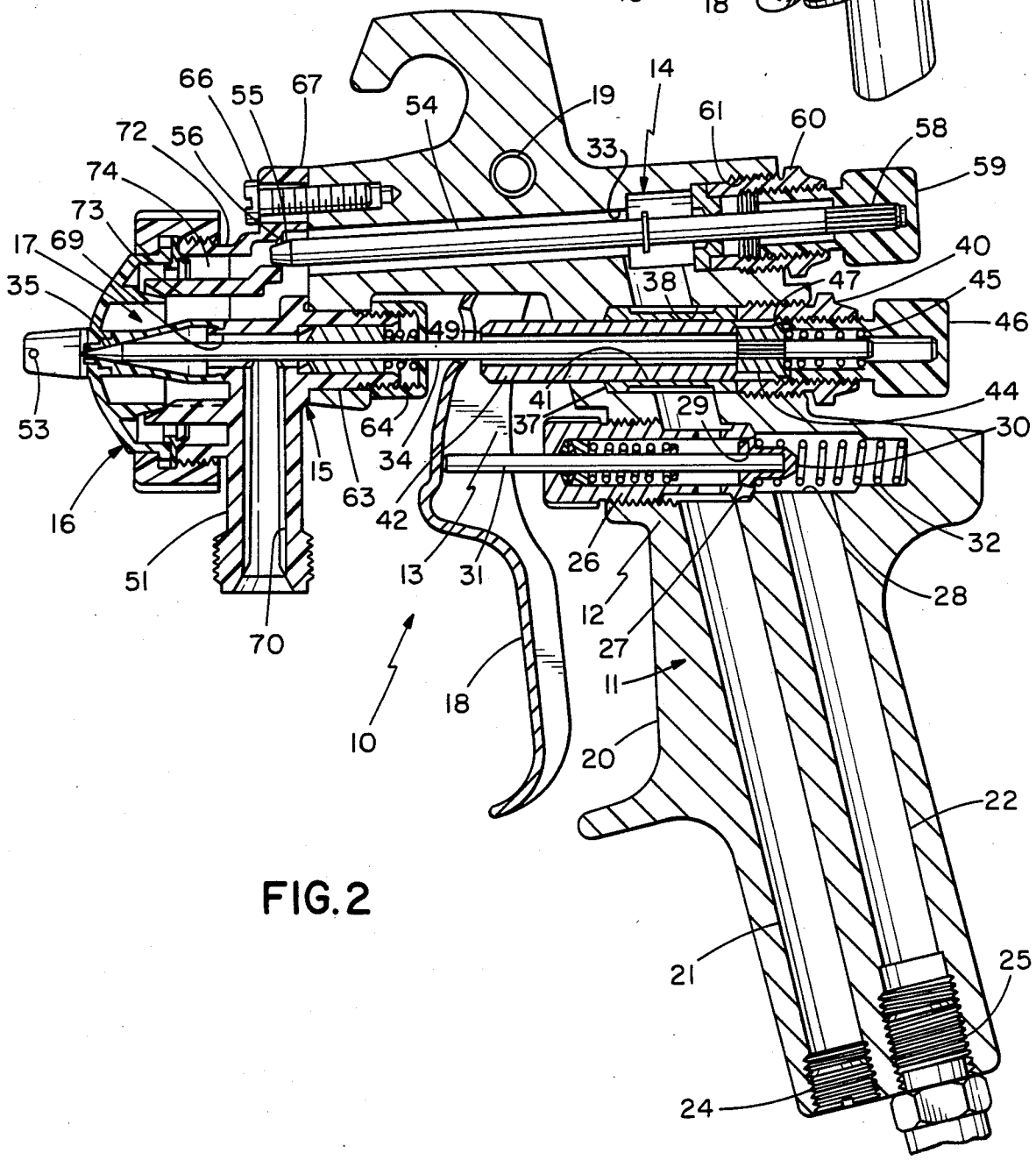
FIG. 2

PAINT SPRAY GUN NOZZLE ASSEMBLY

BACKGROUND OF THE INVENTION

The present spray gun is of the hand-held air syphon operated type in which air is supplied to a control valve in a valve body hand-grip through an air fitting at the base of the grip. The trigger lever operated valve controls the flow of air through the valve body to a nozzle on the muzzle end of the gun, and this air is directed around a nozzle tip extending within an orifice in an air cap surrounding the nozzle tip whereby paint is aspirated through the nozzle from an adjacent container.

The nozzle assembly usually includes three machined parts, i.e., a nozzle, an adapter for attaching the nozzle to the valve body and a fluid inlet fitting connected to the fluid adapter to receive the paint container. These three parts and a fourth, the air cap, are usually constructed of metal and require a plurality of machining operations, rendering the nozzle assembly and air cap a major portion of the cost of the total spray gun.

Over and above the high cost of forming and machining the three nozzle assembly parts and the air cap, a major cause of poor paint atomization in spray guns is air leakage and the joints between the paint inlet fitting and the fluid adapter, between the fluid adapter and the nozzle, and between the adapter and the valve body, significantly increase the likelihood of this air leakage.

While it would be desirable to form the nozzle assembly parts and the air cap from molded plastic materials, it has not thus far been practical because the dimensional instability of plastics in the plastic molding operation does not satisfy the accuracy requirements for the nozzle assembly and air cap. For example, it is extremely important that the nozzle tip be perfectly concentric with the air cap orifice, and plastic moldings have not as yet achieved the required accuracy because of shrinkage and distortion. Furthermore, it is also necessary that the extent of axial projection of the nozzle tip from the air cap orifice be accurately controlled, and it was not heretofore thought possible that such axial control could be achieved with plastic parts.

One attempt to solve these problems is described in the co-pending application of John A. Gloviak and Tom G. Sprandel Ser. No. 727,065, filed Apr. 25, 1985, assigned to the assignee of the present application. In that application, a one-piece nozzle unit and nozzle tip is illustrated in which molding inaccuracies in the tip are corrected by the air cap. This solution, while suitable for many applications, is limited to cases of minimal nozzle tip distortion and relatively thin flexible nozzle tip walls.

It is a primary object of the present invention to ameliorate the problems noted above in conventional airoperated paint spray guns and to provide simplified plastic nozzle assembly and air cap parts.

SUMMARY OF THE PRESENT INVENTION

In accordance with the present invention a paint spray gun is provided with a one-piece plastic nozzle body and a separate plastic nozzle tip that releasably snaps to and is universally mounted on the nozzle body. This permits the air cap to easily align the nozzle tip in the air cap regardless of molding errors in the nozzle body or air cap.

There are important ancillary advantages to the separate nozzle tip. The tip can be removed for cleaning or replacement simply by manually pulling it off the nozzle body without removing the nozzle body from the main frame of the spray gun. The capability of nozzle tip replacement permits different sized nozzles to be used without changing the more expensive part, i.e., the nozzle body. Also, the nozzle tip can be constructed of a different plastic than the nozzle body. For example, the nozzle body may have glass reinforcement and the nozzle tip none.

Toward these ends a one-piece nozzle body includes a pair of spaced annular concentric walls surrounding a separate tapered nozzle tip adapted to receive a needle valve. The nozzle body has a tip receiving spheroidal mount on which the tip is universally mounted, and the tip has an annular inwardly directed flange that snaps over the spheroidal mount in assembly so the tip is locked and sealed to the nozzle body. An air inlet boss that replaces the adapter is provided and communicates with the annular space between the walls as well as the annular space between the inner one of the walls and the nozzle tip to provide the necessary air flow around the tip and to outlet ports in the covering air cap. The outer annular space provides "wing air" to ports found on the air cap.

The inner one of the annular walls has a frusto-conical end surface that engages a complementary frusto-conical surface projecting rearwardly and integrally from the air cap. The air cap also has an annular projection that engages radial shoulders on the nozzle tip. These interengagements accurately axially locate the nozzle tip in the air cap central orifice, which is critical to paint delivery because tip protrusion must be just right—too much or too little will reduce the rate of fluid delivery.

Nozzle tip concentricity with the air cap central orifice is achieved by a plurality of radial vanes on a tapered portion of the nozzle tip that fit within the air caps annular projection which surrounds the air cap orifice. This interengagement of the nozzle vanes with the air cap projection centers the tip in the orifice and eliminates the distortion problems found when the nozzle tip and body are one-piece.

In short, the present nozzle assembly and air cap significantly increase the paint atomization performance, and dramatically reduce manufacturing costs within any sacrifice in spray gun features or reliability.

BRIEF DESCRIPTION OF THE DRAWINGS

FIG. 1 is a perspective view of a paint spray gun according to the present invention;

FIG. 2 is an enlarged longitudinal section of the present paint spray gun taken generally along line 2—2 of FIG. 1;

DETAILED DESCRIPTION OF THE PREFERRED EMBODIMENT

Figure 3:
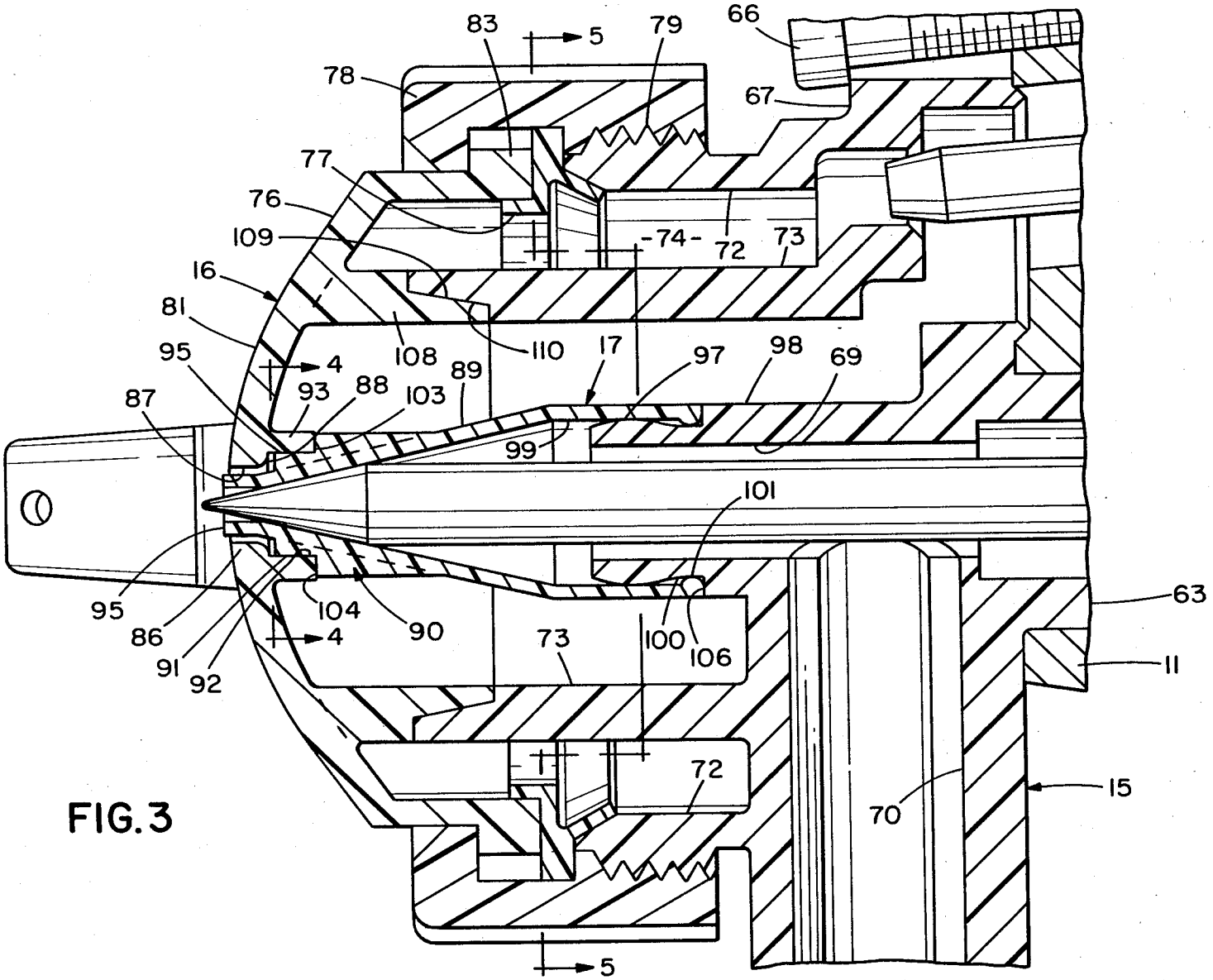
FIG. 3 is an enlarged fragmentary section of the nozzle body, nozzle tip, and air cap assembled together.
Figure 4:
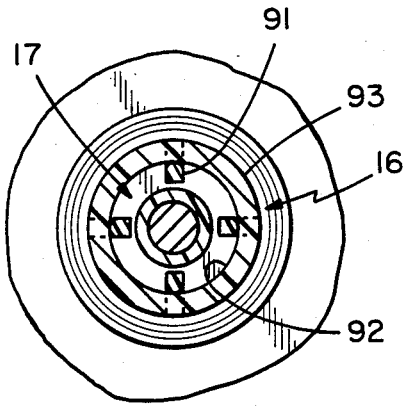
FIG. 4 is a fragmentary cross-section taken generally along line 4—4 of FIG. 3 illustrating the nozzle tip alignment vanes.
Figure 5:
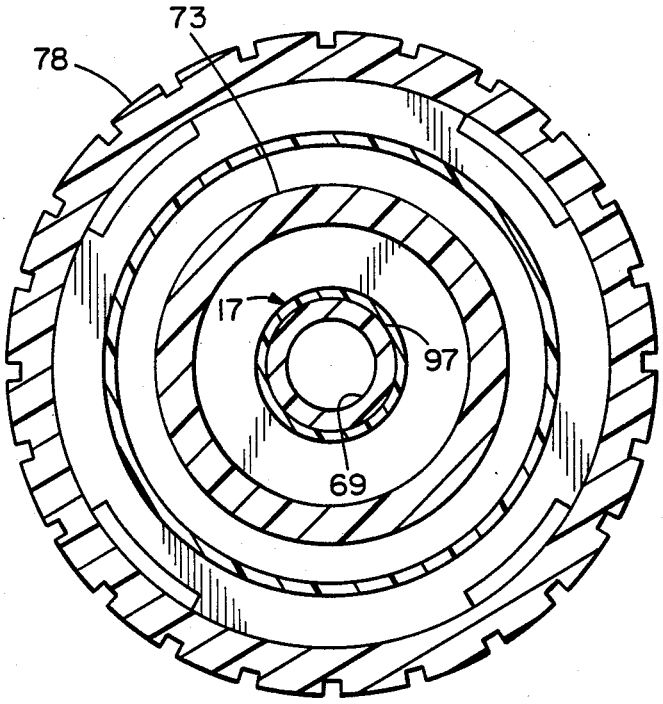
FIG. 5 is a fragmentary view taken generally along line 5—5 of FIG. 3 showing the concentric relationship of the nozzle tip and nozzle body.

Referring to the drawings and particularly to FIGS. 1 and 2, a spray gun 10 according to the present invention is illustrated consisting generally of a body 11, a main air control valve assembly 12, a fluid control valve assembly 13, an air spray or wing air control valve 14, a nozzle body 15, a nozzle tip 17 and an air cap assembly 16, with air valve assembly 12 and fluid valve assembly 13 being operated by a finger grip lever 18 pivoted on the body at 19.

The body or frame 11 is generally "L" shaped and has a hand grip portion 20 with spaced parallel bores 21 and 22 therein. Bore 21 is plugged at its lower end 24 and an air inlet fitting 25 is threaded into the lower end of bore 22.

The air valve assembly 12 controls air flow between passages 22 and 21 to initiate and modulate the flow of compressed air to the nozzle body 15 and air cap assembly 16, and includes a body member 26 threaded into handle grip 20 intersecting bore 22 and engaging a stepped shoulder 27 in a bore 28 interconnecting passages 21 and 22. Body member 26 has a valve seat 29 against which a valve member 30 is biased by compression spring 32 toward its closed position. Valve member 30 is selectively movable to its open position by rod 31 upon counterclockwise pivotal movement of the lever 18, as seen in FIG. 2. Upon depression of handle 18 valve member 30 opens permitting compressed air to flow from passage 22 to passage 21, through bore 33 to the nozzle body 15 and air cap assembly 16.

The fluid or paint control valve 13 includes a needle valve 34 having a frusto-conical tip 35 that cooperates with frusto-conical nozzle tip 17, pivotally attached to the nozzle body 15, orifice for the control of paint flow through the nozzle tip 17. Valve assembly 13 also includes a sleeve 37 in a handle bore 38 held in position by a threaded bushing 40 together defining a bore 41 that slidably receives an actuator sleeve 42 and bushing 44, the latter being pressfitted on needle valve 34. Valve 34 is biased to its closed position illustrated in FIG. 2 by a coil compressing spring 45 seated in adjustment knob 46 and reacting against the bushing 44 urging it toward the left as seen in FIG. 2. Knob 46 is threadedly engaged in bushing 40 and limits the opening movement of valve 34 when bushing rim 47 enages the knob. Knob 46 is unthreaded from its position shown in FIG. 2 to permit opening movement of valve 34. Lever 18 engages end 49 of sleeve 42 to cause opening movement of the valve 34 after valve 12 opens by shiftiing bushing 44 to the right from its position shown in FIG. 2, opening valve 34 permitting paint to flow through nozzle unit inlet fitting 51 across open needle valve portion 35.

The air spray or wing air valve assembly 14 controls air flow through passage 33 to wing spray ports 53 that direct an air spray against paint flow from nozzle tip 17 to control the flow pattern. Valve assembly 14 includes a rod valve 54 having a frusto-conical tip 55 adjustably positionable in a frutso-conical valve seat 56 formed in the nozzle body 15. Rod valve 54 has a straight knurl 58 at its right end pressed in adjustment knob 59 in turn threaded into a bushing 60 threaded into a body bore 61. Rotation of knob 59 varies the flow area at valve seat 56 and hence the flow rate through wing ports 53.

The nozzle body 15 is a one-piece plastic molding, preferably constructed of glass reinforced nylon, and is seen to include a valve guide portion 63 extending through a bore in the forward end of valve body 11, having a threaded end that receives a threaded cap 64 that hold the nozzle body 15 against the forward face of the valve body 11 with the assistance of a threaded fastener 66. The guide portion 63 extends rearwardly from a vertically elongated base portion 67 shown more clearly in FIG. 1, and the nozzle tip 17 extends coaxially (when aligned) with respect to the guide portion 63 forwardly from the base portion 67. Inlet fitting 51 extends transversely from the nozzle tip receiving portion 98 that has an axial passage 69 therethrough communicating with passage 70 in inlet fitting 51 which is adapted to be connected to a conventional paint supply container (not shown).

The nozzle body 15 has a pair of forwardly projecting annular walls 72 and 73 from base 67 that define an annular passage 74 for the supply of air from valve assembly 14 through valve seat 56 to the wing air spray ports 53 in air cap 16.

As seen more clearly in FIG. 3, the air cap assembly 16 includes an air cap 76 clamped in position against an annular seal 77 by a cup-shaped plastic nut 78 that threadedly engages external threads 79 on the nozzle body outer annular wall 72.

Figure 6:
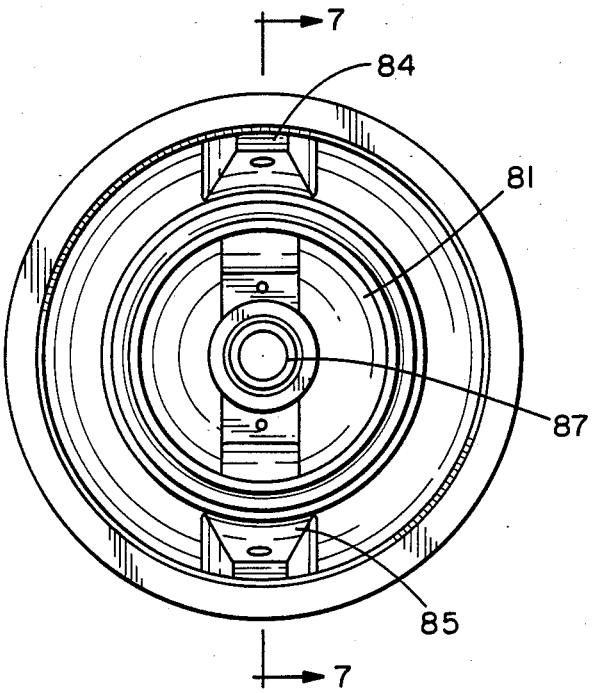
FIG. 6 is a front view of the air cap sub-assembly.
Figure 7:
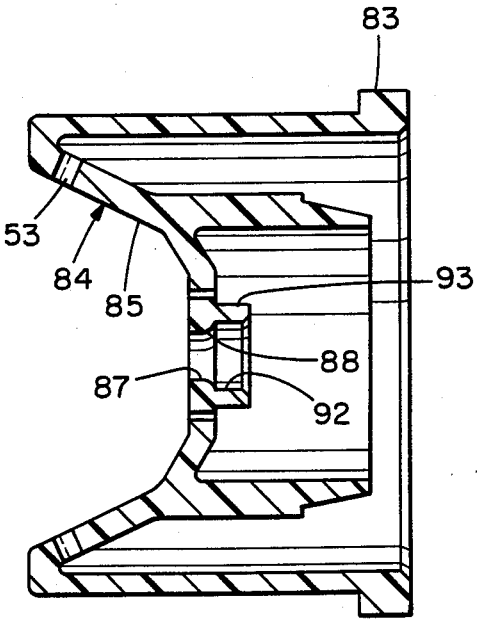
FIG. 7 is a long longitudinal section of the air cap taken generally along line 7—7 of FIG. 6.

The air cap 76 is a one-piece plastic molding, preferably constructed of a durable plastic such as glass reinforced nylon, and is seen in FIGS. 3, 6 and 7 to include a central cup-shaped portion 81, and an annular outer flange 83 against which nut 78 clamps. Diametrally spaced ears or wings 84 extend forwardly from portion 81 and have outwardly diverging flat inner surfaces 85 in which the spray ports 53 are formed.

The cup-shaped portion 81 has a central wall portion 86 in which orifice 87 is centrally formed. Orifice 87 has a semi-torroidal rear surface 88 to reduce turbulence. Orifice 87 and the straight portion of the distal end of nozzle tip 17 determine the effective flow area for syphon air flowing past nozzle tip end 95.

The frusto-conical portion 89 of nozzle tip 17 has four integral equally spaced radial vanes 90 having stepped forward portions 91 that engage a cylindrical inner wall 92 in an annular projection 93 extending rearwardly from air cap portion 81, to accurately align the nozzle tip 17 on the axis of the orifice 87 in air cap 76. These vane stepped portions 91 have outer edges 95 that extend parallel to the axis of the nozzle tip 17 and have line contact with the air cap wall 92.

The nozzle tip 17 may be constructed of a different plastic than nozzle body 15, for example it may be an unfilled nylon having a lower fluid frictional coefficient. Tip 17 is universally pivotally mounted on the nozzle body 15 by a spheroidal projection 97 on the tip receiving portion 98 of nozzle body 15. Projection 97 snugly fits in nozzle tip annular wall 99 but permits the tip to pivot bearing in mind that the walls of tip 17 are somewhat flexible.

The tip 17 is replaceable on nozzle body 15 and toward that end the inner end of tip 17 has an inwardly directed flange 101 with an inner diameter less than the outer diameter of the spheroidal projection 97 so it stretches slightly over the projection as it is pushed axially thereover and then it snaps radially inwardly into the position illustrated in FIG. 3 into sealing engagement with reduced diameter portion 100.

After attaching the tip 17 to nozzle body 15, the assembly of air cap 16 to the body 15 pivots the tip 17 on projection 97 into coaxial alignment with orifice 87 in the air cap.

The air cap projection also has a radial shoulder 103 that engages radial shoulders 104 on vanes 90 to push the tip rearwardly so flange 101 seats and seals axially against shoulder 106 on nozzle body portion 98 to thereby axially locate the nozzle tip both with respect to the air cap and the nozzle body 15. This also performs the extremely important function of controlling the amount of protrusion of nozzle tip end 95 forwardly from the orifice 87.

The air cap portion 81 has a rearwardly extending annular wall 108 with an outer frusto-conical surface 109 that engages an inner frusto-conical forward surface 110 on the forward end of nozzle body wall 73. These frusto-conical surfaces both radially and axially locate the air cap 76 with respect to the nozzle body 15. Moreover, the wall sections throughout the nozzle body 15 and the air cap 16 are relatively thin so that they are flexible under the inter-engaging forces produced at surfaces 109 and 100.

We claim:

1. A paint spray gun, comprising: a valve body having an air passage therethrough adapted to be connected to a source of compressed air, a control valve in the passage for controlling the flow of air, a unitary plastic nozzle body including an air inlet passage, a paint inlet passage and an elongated nozzle tip receiving portion connected to receive paint from the paint inlet passage, a nozzle tip separate from the nozzle body pivotally mounted on the nozzle tip receiving portion, an air cap mounted on and covering the nozzle body and adapted to receive air from the nozzle unit air inlet, said air cap having a central orifice into which the separate nozzle tip projects, and interengaging means on the air cap immediately adjacent the orifice and the forward end of the nozzle tip for pivoting and aligning the plastic nozzle tip in the air cap orifice by relative movement between the nozzle tip and the nozzle body even though the nozzle tip is not perfectly concentric with the orifice.

2. A paint spray gun as defined in claim 1, wherein the interengaging means includes an annular projection on the air cap concentric with the orifice having an inner annular surface, and a plurality of integral radial vanes projecting outwardly from the distal end of the nozzle tip.

3. A paint spray gun as defined in claim 2, wherein the air cap is a unitary plastic molding.

4. A paint spray gun as defined in claim 1, including second interengaging means on the air cap and nozzle body for axially locating the air cap on the nozzle body.

5. A paint spray gun as defined in claim 4, wherein the second interengaging meand includes a pair of interengaging frusto-conical surfaces on the air cap and the nozzle body.

6. A paint spray gun as defined in claim 1, wherein the nozzle tip has a releasable snap lock connection to the tip receiving portion.

7. A paint spray gun as defined in claim 1, wherein the pivotal connection includes a flexible inwardly directed radial flange on the inner end of the nozzle tip that snaps over a semi-spheroidal surface on the tip receiving portion.

8. A paint spray gun, comprising: a valve body having an air passage therethrough adapted to be connected to a source of compressed air, a control valve in the passage for controlling the flow of air, a unitary plastic nozzle body including an air inlet passage, a paint inlet passage and an elongated nozzle tip receiving portion connected to receive paint from the paint inlet passage, a nozzle tip separate from the nozzle body movably mounted on the tip receiving portion, an air cap covering the nozzle body and adapted to receive air from the nozzle body air inlet, said air cap having a central orifice into which the nozzle tip projects, and interengaging means on the air cap and the separate nozzle tip for biasing the nozzle tip rearwardly thereby axially locating the nozzle tip with respect to the nozzle body, the interengaging means including a rearwardly extending annular wall on the air cap surrounding the orifice and the forward end of the nozzle tips engaging a radial shoulder on the forward end of the nozzle tip.

9. A paint spray gun, comprising: a valve body having an air passage therethrough adapted to be connected to a source of compressed air, a control valve in the passage for controlling the flow of air, a unitary plastic nozzle body including an air inlet passage, a paint inlet passage and an elongated nozzle tip receiving portion connected to receive paint from the paint inlet passage, said nozzle body air inlet passage being annular in configuration and defined by a pair of integral substantially concentric radially spaced annular walls, the inner one of said annular walls having a frusto-conical alignment surface, said nozzle body paint inlet passage being defined by an integral fitting extending transversely from the nozzle body, a nozzle tip separate from the nozzle body mounted for universal movement on the nozzle tip receiving portion, a needle valve axially movable in the nozzle tip to control paint flow, a one-piece plastic air cap mounted on and over the nozzle body having a central orifice and an annular air passage communicating with the nozzle body air inlet passage, and a plurality of air outlet ports in the air cap, said air cap having a frusto-conical surface aligned with an engaging the frusto-conical surface on the nozzle body inner wall to axially locate the air cap on the nozzle body, said air cap having a rearwardly extending annular wall immediately around the orifice for receiving and engaging the forward end of the nozzle tip.

10. A paint spray gun as defined in claim 8, wherein said nozzle body includes a rearwardly extending integral fitting adapted to slidably receive the needle valve.

11. A paint spray gun, comprising: a valve body having an air passage therethrough adapted to be connected to a source of compressed air, a control valve in the passage for controlling the flow of air, a unitary plastic nozzle body including an air inlet passage, a paint inlet passage and an elongated nozzle tip receiving portion connected to receive paint from the paint inlet passage, said nozzle body air inlet passage being annular in configuration and defined by a pair of integral substantially concentric radially spaced annular walls, the inner one of said annular walls having a frusto-conical alignment surface, said nozzle body paint inlet passage being defined by an integral fitting extending transversely from the nozzle unit, a nozzle tip separate from the nozzle body having a flexible inwardly directed rim that snaps over a spheroidal projection on the end of the nozzle tip receiving portion, said nozzle tip being pivotally mounted on the spherical projection, a one-piece plastic air cap mounted over the nozzle body having a central orifice and an annular air passage communicating with the nozzle body air inlet passage, and a plurality of air outlet ports in the air cap, said air cap having a frusto-conical surface aligned with and engaging the frusto-conical surface on the nozzle body inner wall, said nozzle tip including a frusto-conical portion with a plurality of radially extending vanes thereon, said vanes each having an axially extending outer surface parallel to the axis of the nozzle tip portion, said air cap having a rearwardly extending annular projection coaxial with the orifice and adapted to receive and engage the vanes' outer surfaces to pivot and align the nozzle tip in the air cap orifice, said vanes each having a stepped portion defining radial shoulders that engage the annular projection on the air cap to axially locate the nozzle tip with respect to the nozzle body.

* * * * *